US009216572B2

(12) United States Patent
Sudo et al.

(10) Patent No.: US 9,216,572 B2
(45) Date of Patent: Dec. 22, 2015

(54) PRINTING DEVICE AND PRINTING METHOD

(71) Applicant: SEIKO EPSON CORPORATION, Tokyo (JP)

(72) Inventors: Naoki Sudo, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/141,006

(22) Filed: Dec. 26, 2013

(65) Prior Publication Data

US 2014/0204140 A1 Jul. 24, 2014

(30) Foreign Application Priority Data

Jan. 24, 2013 (JP) ..... 2013-010928

(51) Int. Cl.
*B41J 2/165* (2006.01)
*B41J 2/07* (2006.01)

(52) U.S. Cl.
CPC ..... *B41J 2/07* (2013.01); *B41J 2/16526* (2013.01); *B41J 2002/16529* (2013.01)

(58) Field of Classification Search
CPC ..... B41J 2/07; B41J 2/04516; B41J 2/11; B41J 2/165; B41J 2/16517; B41J 2/1652; B41J 2/16526; B41J 2/16585
USPC ..... 347/35
See application file for complete search history.

(56) References Cited

U.S. PATENT DOCUMENTS

| | | | | |
|---|---|---|---|---|
| 2005/0270323 | A1* | 12/2005 | Oshio et al. | 347/14 |
| 2005/0275683 | A1* | 12/2005 | Furuichi et al. | 347/35 |
| 2007/0057983 | A1* | 3/2007 | Kawaguchi et al. | 347/9 |
| 2010/0091053 | A1* | 4/2010 | Jackson et al. | 347/9 |
| 2012/0075373 | A1 | 3/2012 | Ito | |
| 2012/0206523 | A1* | 8/2012 | Hirosawa et al. | 347/12 |

FOREIGN PATENT DOCUMENTS

| | | | |
|---|---|---|---|
| JP | 07-314708 | A | 12/1995 |
| JP | 2011-170281 | A | 9/2011 |
| JP | 2012-091499 | A | 5/2012 |
| JP | 2012-166450 | A | 9/2012 |

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

A printing device include a control section that causes the head to execute an ejection operation of forming an image forming dot for printing an image designated as a print target and a flushing dot other than the image forming dot on a printing medium, wherein the control section has an acquiring unit that acquires a prescribed parameter in printing conditions for forming the image forming dot on the printing medium, a determining unit that determines a margin area in which the flushing dot is not formed in an end portion of the printing medium based on the prescribed parameter, and an executing unit that executes the ejection operation so as not to form the flushing dot in the margin area on the printing medium.

7 Claims, 7 Drawing Sheets

PRINTING DEVICE AND PRINTING METHOD

CROSS-REFERENCE TO RELATED APPLICATIONS

This application claims priority to Japanese Patent Application No. 2013-010928 filed on Jan. 24, 2013. The entire disclosure of Japanese Patent Application No. 2013-010928 is hereby incorporated herein by reference.

BACKGROUND

1. Technical Field

The present invention relates to a printing device and a printing method.

2. Background Technology

An inkjet printer is known in which printing is conducted by feeding paper in one direction, moving a head having a plurality of nozzles back and forth in another direction perpendicular to the one direction, and ejecting ink from each of the nozzles. In the inkjet printer, when a state in which ink is not ejected from the nozzles lasts, there are cases in which the moisture of ink evaporates from the openings of the nozzles so as to increase the viscosity of ink. When the viscosity of ink is increased, there are cases in which clogging of the nozzles occurs and the ejection operation of ink becomes unstable. In order to avoid these situations, as shown in Patent Document 1, for example, an apparatus has been proposed in which a flushing process of ejecting ink from each of nozzles is conducted to a margin area of cut sheet paper so as to prevent or solve clogging of the nozzles. Also, Patent Document 2 has disclosed a line head printing device in which a plurality of heads are arranged in a line pattern in another direction, and a nozzle line is formed by arranging nozzles such that the nozzles are overlapped so as to join the heads. In this nozzle line, ejection for forming an image is conducted by one nozzle, and flushing is conducted between images by another nozzle.

Japanese Laid-open Patent Publication No. H7-314708 (Patent Document 1) and Japanese Laid-open Patent Publication No. 2012-166450 (Patent Document 2) are examples of the related art.

SUMMARY

Problems to be Solved by the Invention

In this manner, in a case in which flushing is conducted on paper, it is preferable to conduct flushing to the entire surface of the paper for efficiency. When flushing is conducted to the entire surface of the paper, however, a curl phenomenon that curves paper easily occurs. Therefore, a technique for determining a flushing area of paper to prevent the curl phenomenon from occurring has been desired. However, no technique or device that determines a flushing area based on the printing conditions has been disclosed. The advantage of the invention is to determine a flushing area of paper based on printing conditions.

Means Used to Solve the Above-Mentioned Problems

The invention has been made to address at least part of the above-described circumstances, and the invention can be implemented as the following embodiments or application examples.

Application Example 1

According to the present application example, a printing device includes a head that has a plurality of nozzles, and a control section that causes the head to execute an ejection operation of forming an image forming dot for printing an image designated as a print target and a flushing dot other than the image forming dot on a printing medium by moving either one of the printing medium and the head so as to relatively change the positions of the printing medium and the head and ejecting liquid from each of the nozzles. The control section has an acquiring unit that acquires a prescribed parameter in printing conditions for forming the image forming dot on the printing medium, a determining unit that determines a margin area in which the flushing dot is not formed in an end portion of the printing medium based on the prescribed parameter, and an executing unit that executes the ejection operation so as not to form the flushing dot in the margin area on the printing medium.

With this configuration, the margin area in which the flushing dot is not formed in the end portion of the printing medium is determined based on the prescribed parameter in the printing conditions for forming the image forming dot on the printing medium by the head, and the head forms the flushing dot in an area except the margin area of the printing medium. Accordingly, since the margin area in which the flushing dot is not formed on the printing medium is determined based on the prescribed parameter of the printing conditions, the flushing area of the printing medium can be determined based on the printing conditions.

Application Example 2

In the printing device according to the above-described application example, preferably, the printing medium is paper, and the prescribed parameter is at least one of the grain direction of the paper, the kind of the paper, and the feed speed of the paper.

With this configuration, the margin area can be determined based on at least one of the grain direction of the paper, the kind of the paper, and the feed speed of the paper.

Application Example 3

In the printing device according to the above-described application example, the determining unit determines the margin area such that the margin area becomes larger in the order of gloss paper, heavy paper, regular paper, and recycled paper as the kind of paper.

With this configuration, when liquid is ejected onto paper that is easy to deform, deformation of the paper can be reduced by increasing the margin area of the paper.

Application Example 4

In the printing device according to the above-described application example, the determining unit can determine the margin area based on a remaining amount of a chemical solution for causing aggregation or deposit of a colorant of the liquid, or a print resolution.

Application Example 5

In the printing device according to the above-described application example, the determining unit does not provide the margin area in a case in which a print mode for defining a printing area to the printing medium is a prescribed mode.

With this configuration, the existence or non-existence of the margin area can be determined corresponding to the printing area.

Application Example 6

In the printing device according to the above-described application example, in a case in which the control section causes the head to form the image forming dot on the printing medium, the control section generates flushing data that does not form the flushing dot in the margin area on the printing medium, superimposes the generated flushing data and print data showing the image to be printed, and causes the head to execute ejection of the liquid onto the printing medium based on the superimposed data.

With this configuration, since the liquid is ejected based on the print data and the flushing data, the print process and the flushing process can be efficiently conducted.

Application Example 7

In the printing device according to the above-described application example, the plurality of nozzles can be arranged in the head in a direction that intersects with a direction for relatively changing the positions of the printing medium and the head.

Application Example 8

According to the present application example, a printing method is a method of forming an image forming dot for printing an image designated as a print target by ejection of liquid using a plurality of nozzles for ejecting liquid, the method including an acquiring step that acquires a prescribed parameter in printing conditions for forming the image forming dot on a printing medium, a determining steps that determines a margin area in which a flushing dot other than the image forming dot is not formed in an end portion of the printing medium based on the prescribed parameter, and an executing step that executes an ejection operation so as not to form the flushing dot in the margin area on the printing medium.

With this method, the margin area in which the flushing dot is not formed in the end portion of the printing medium is determined based on the prescribed parameter in the printing conditions for forming the image forming dot on the printing medium by the head, and the line head forms the flushing dot in an area except the margin area of the printing medium. Accordingly, since the margin area in which the flushing dot is not formed on the printing medium is determined based on the prescribed parameter of the printing conditions, the flushing area of the printing medium can be determined based on the printing conditions.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, the embodiments of the invention will be explained with reference to the drawings.

First Embodiment

Figure 1:
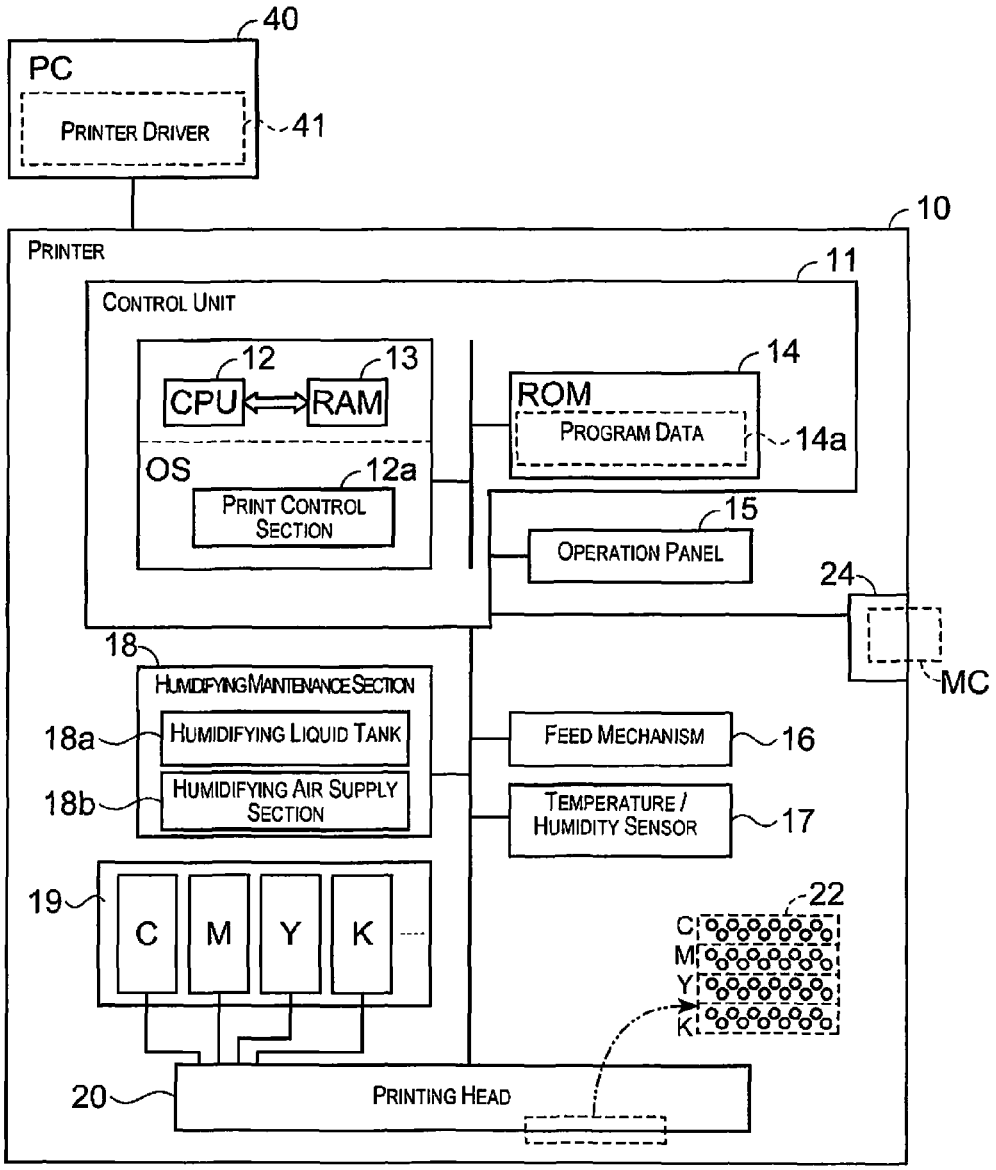
FIG. 1 is a diagram that schematically shows a hardware configuration and a software configuration of a printing device according to a first embodiment of the invention.

Hereinafter, the first embodiment of the invention will be explained with reference to the drawings. FIG. 1 schematically shows a hardware configuration and a software configuration of a personal computer (PC) 40 and a printer 10. The printer 10 corresponds to a printing device. However, a system that includes the PC 40 and printer 10 can be considered as the printing device. The printer 10 has a control unit 11 for controlling a liquid ejection process (print process). In the control unit 11, a CPU 12 opens program data 14*a* such as firmware stored in a memory such as a ROM 14 in a RAM 13 and conducts calculation in accordance with the program data 14*a* under an OS, so as to control each function of a print control section 12*a* or the like.

The print control section 12*a* inputs image data from a storage medium or the like inserted from outside into the PC 40 or the printer 10, for example, and generates print data from the image data. Then, printing can be conducted based on the print data. The storage medium inserted from outside into the printer 10 refers to a memory card MC, for example. The memory card MC is inserted into a slot portion 24 that is formed in a case body of the printer 10. The print control section 12*a* can input image data from various external devices such as a scanner connected to the printer 10 in a wired or wireless manner, a digital still camera, a cell phone terminal, or a server connected via a network. The image data shows an image (print target image) that a user arbitrarily designates as a print target. For example, the image data is bit map data, RGB data that has tones of a color system of red, green, and blue (R, G, and B) for each pixel, or ink amount data that has tones of an ink color system (cyan (C), magenta (M), yellow (Y), black (K), and the like) used by the printer 10 for each pixel. The control section 12*a* conducts a resolution conversion process, a conversion process of the color system (color conversion process), a halftone process, or the like to the bit map data, so as to generate print data. The print data is data for each kind of ink in which ejection (dot on) and non-ejection (dot off) of liquid (ink) is specified for each pixel.

The print control section 12*a* receives print data generated from image data by a printer driver 41 from the PC 40 so as to conduct printing based on the received print data. The printer driver 41 is installed in the PC 40. Alternatively, the print control section 12*a* receives PDL data expressed by a prescribed page description language (PDL) from the printer driver 41 so as to conduct printing of a print target image based on the PDL data. In this case, the print control section 12*a* converts the PDL data into an intermediate code by analyzing the PDL data, and generates bit map data on the RAM 13 by opening the intermediate code. The print control section 12*a* generates print data from the bit map data.

The printer 10 has a cartridge 19 for each of a plurality of kinds of liquid. In the example of FIG. 1, the cartridge 19 is installed corresponding to each ink of CMYK. However, the specific kind or number of the liquid used by the printer 10 is not limited. For example, various kinds of ink such as light cyan, light magenta, orange, green, gray, light gray, white, metallic ink, or precoat liquid or the like that is a chemical solution for causing aggregation or deposit of a coloring component of each ink can be used. Also, the printer 10 has a printing head 20 for ejecting (injecting) liquid, supplied from each cartridge 19, from a great number of nozzles 22 for liquid ejection. The printing head 20 is a so-called line head that has an elongated shape. Incidentally, FIG. 1 shows the position of the nozzles 22 in the printing head 20, but does not show the arrangement configuration of the nozzles 22. According to the first embodiment, in the printing head 20, a nozzle line is formed by arranging a plurality of short heads 21 (see FIG. 3) in a zigzag pattern and providing the nozzles 22 in each head 21. However, the arrangement of the nozzle line is not limited. The arrangement of the nozzles 22 for each color can be configured as a plurality of nozzle lines that are displaced in a longitudinal direction with a prescribed pitch as shown in FIG. 1, or can be configured as a single nozzle line lined up along the longitudinal direction.

The print control section 12*a* generates a driving signal for driving the printing head 20, a feed mechanism 16, or the like based on the print data. A piezoelectric element is provided for each nozzle 22 in the printing head 20 so as to eject liquid drops (dots) from the nozzle 22. The piezoelectric element is deformed when the driving signal is applied, and causes dots to be ejected from the corresponding nozzle 22. The feed mechanism 16 has a motor (not shown in the drawings), rollers 16*a*, 16*b*, and 16*c* (see FIG. 2) that rotate by the motor, and the like. The feed mechanism 16 feeds a printing medium along a prescribed feed direction by driving control using the print control section 12*a*. When ink is ejected from each nozzle 22 of the printing head 20, dots adhere onto the printing medium under feeding, and a print target image is reproduced on the printing medium based on the print data. Here, although paper P is conceived as the printing medium in the first embodiment, the printing medium is not limited to paper. The printer 10 has an operation panel 15. The operation panel 15 includes a display section (for example, a liquid crystal panel), a touch panel, various kinds of buttons, and keys. The touch panel, the buttons, and the keys are formed on the display section. The operation panel 15 displays a user interface (UI) screen on the display section or receives input of the printing conditions or the like from a user. The printing conditions can include the kind of the paper P, the direction of the printing, the layout with respect to the paper P, the print resolution, the necessity of double-sided printing, and the like.

In addition to a print operation from the operation panel 15, it is also possible to cause the printer 10 to print a print target image by operating the PC 40. A user inputs print instructions or printing conditions of a print target image through a UI screen presented by the printer driver 41 on a display of the PC 40. Also, the information showing the printing conditions that has been input in this manner is transmitted from the PC 40 to the printer 10 together with the print data. Also, the printer 10 has a temperature/humidity sensor 17 that acquires temperature or humidity, and a humidifying maintenance section 18. The humidifying maintenance section 18 has a humidifying liquid tank 18*a* for storing humidifying liquid that includes a non-volatile component, and a humidifying air supply section 18*b* for supplying air, humidified by the humidifying liquid stored in the humidifying liquid tank 18*a*, to a sealed space facing an opening of the nozzle 22. The humidifying maintenance section 18 controls increase in the viscosity of the ink in the nozzle 22.

Figure 2:
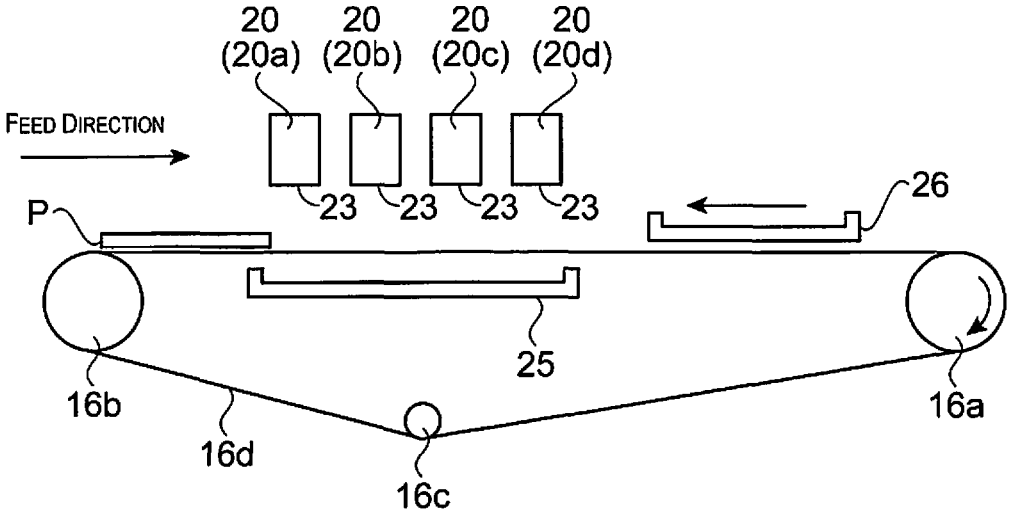
FIG. 2 is a diagram that illustrates a part of an internal configuration of the printing device according to the first embodiment of the invention in a simplified manner.

FIG. 2 illustrates a part of an internal configuration of the printer 10 in a simplified manner from view in the longitudinal direction of the printing head 20. The printing head 20 has a plurality of line heads 20*a*, 20*b*, 20*c*, and 20*d* for each kind of ink. The line heads 20*a*, 20*b*, 20*c*, and 20*d* have the same configuration. For example, the line head 20*a* can execute ejection of C ink, the line head 20*b* can execute ejection of M ink, the line head 20*c* can execute ejection of Y ink, and the line head 20*d* can execute ejection of K ink, respectively. The line heads 20*a*, 20*b*, 20*c*, and 20*d* are fixed in prescribed positions in the printer 10, for example, in a state in which the line heads 20*a*, 20*b*, 20*c*, and 20*d* are in parallel with each other in the longitudinal direction. Hereinafter, the "longitudinal direction" always refers to a longitudinal direction of each of the line heads 20*a*, 20*b*, 20*c*, and 20*d* unless it is described otherwise.

As shown in FIG. 2, an endless belt 16*d* that moves by being caught with the rotating rollers 16*a*, 16*b*, and 16*c* is provided in a position opposed to a nozzle opening surface 23 as the feed mechanism 16. The paper P is fed in a feed direction by being placed on the endless belt 16*d*, and undergoes ejection of ink from the nozzle 22 when passing below the nozzle opening surface 23. The longitudinal direction of the line heads 20*a*, 20*b*, 20*c*, and 20*d* is a direction that intersects with the feed direction of the paper P, and the line heads 20*a*, 20*b*, 20*c*, and 20*d* are arranged at prescribed intervals in the feed direction. "Intersection" described herein refers to perpendicular intersection. However, perpendicular intersection described in the present specification does not mean an exact angle (90°) alone, and includes an error of the angle to an extent that is accepted in terms of the quality of the product.

In the first embodiment, mainly, the explanation is continued based on an assumption that the printing head 20 is fixed and the paper P is fed by the feed mechanism 16. However, it can be configured such that the printing head 20 moves by a carriage with respect to the paper P that does not move (or temporarily stops moving). Specifically, it is sufficient that at least one of the paper P and the printing head 20 moves and the positions of the paper P and the printing head 20 relatively change along a prescribed direction. In the case of moving the printing head 20, the longitudinal direction is a direction that intersects with the direction (the prescribed direction) for relatively changing the positions of the paper P and the printing head 20. Accordingly, a "movement distance" in the following description refers to a change amount of the position between the paper P and the printing head 20 in the prescribed direction.

In the first embodiment, the printer 10 can execute flushing. Flushing refers to a specific operation for forming dots other than dots for printing a print target image by ejecting ink from the nozzles 22 so as to control increase in the viscosity of ink in the printing head 20. Dots for printing a print target image (dots constituting print data) can be called as image forming dots, and dots other than the image forming dots can be called as flushing dots. Here, ink drops by the flushing dots have very small volumes. Therefore, even if the ink drops land on the paper P, the ink drops cannot be observed with the naked eye.

Flushing includes "first flushing" that conducts ink ejection to a place other than the paper P, and "second flushing" that conducts ink ejection to the paper P. The first flushing uses, for example, a waste solution cap 26. The waste solution cap 26 moves to below the nozzle opening surface 23 so as to cover the nozzle opening surface 23 at a timing of execution of the first flushing in response to control by the control unit 11. The printing head 20 ejects ink from each nozzle 22 as the first flushing in a state where the nozzle opening surface 23 is covered with the waste solution cap 26. Ink ejected in this manner is stored in the waste solution cap 26. The waste solution cap 26 returns to a prescribed original position after completion of the first flushing in response to control by the control unit 11.

Also, as an example of the first flushing, the printer 10 can conduct flushing to the endless belt 16*d*. In this case, a waste solution saucer 25 for receiving a waste solution is provided in a position that is opposed to the nozzle opening surface 23 in a state in which the endless belt 16*d* is sandwiched. For example, the endless belt 16*d* can be formed in a mesh shape such that ink ejected onto the belt surface can pass therethrough. As the first flushing, the printing head 20 ejects ink from each nozzle 22 at a prescribed timing when the paper P does not exist below the nozzle opening surface 23. Ink ejected in this manner passes through the endless belt 16*d* and is stored in the waste solution saucer 25. Incidentally, the printer 10 can be provided with a wiper or the like to clean the belt surface of the endless belt 16*d* that becomes dirty when ink ejected by the first flushing passes therethrough.

The second flushing (ejection operation) is executed when a print process of a print target image is executed. The print control section 12*a* artificially generates flushing data FLD (FIG. 3) that expresses a dot pattern for repeatedly ejecting flushing dots at prescribed distance intervals in pixel lines constituting a print target image that are in parallel with each other in the feed direction. The print control section 12*a* has a function (acquiring unit) of acquiring a prescribed parameter included in the acquired printing conditions. Based on the prescribed parameter acquired by this function, the nozzles 22 in the longitudinal direction for ejecting the flushing dots are determined. Specifically, the print control section 12*a* has a function (determining unit) that determines a prescribed margin area in which ink for the second flushing is not ejected from the nozzles 22 in both end portions in a width direction perpendicular to the feed direction of the paper P. The print control section 12*a* generates the flushing data FLD that does not cause ink to be ejected in the determined margin area. Here, in the first embodiment, the kind of paper is conceived as the prescribed parameter.

Figure 3:
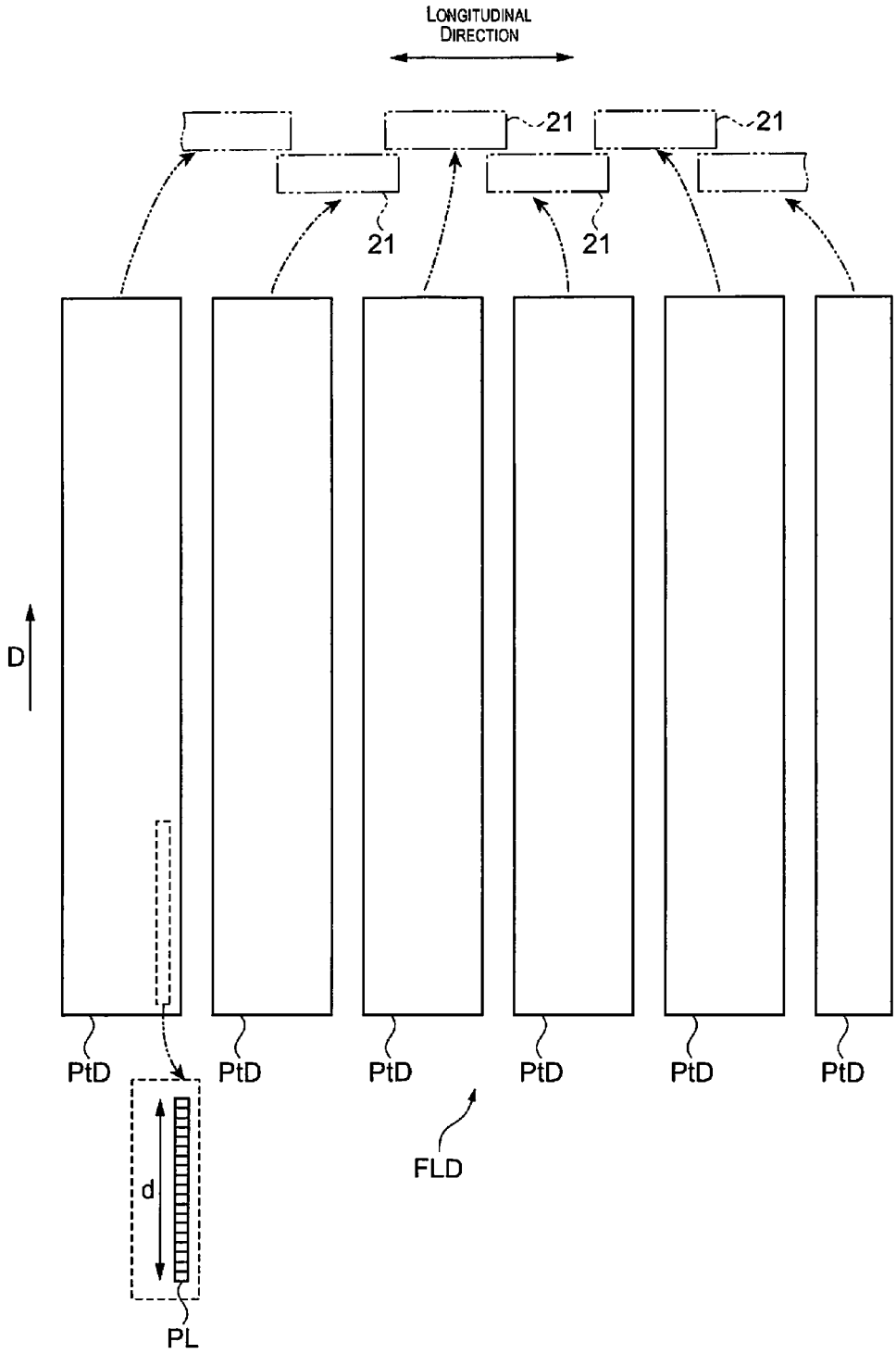
FIG. 3 is a diagram that illustrates flushing data in a simplified manner.

The print control section 12*a* has a function (executing unit) of superimposing (synthesizing) the flushing data FLD and the print data that shows a print target image, and causing the printing head 20 to execute ink ejection based on the superimposed data. By this function, dots are formed on the paper P corresponding to each pixel in which dot on can be obtained by OR in the results of the superimposing. Therefore, clogging of the nozzles 22 can be prevented or solved at the same time when printing a print target image. Here, dots formed on the paper P corresponding to a pixel in which dot on is specified in either data when superimposing the flushing data FLD and the print data that shows a print target image are both of the image forming dots and the flushing dots. The second flushing does not temporarily stop printing of a print target image as the first flushing does. Therefore, the second flushing greatly contributes to improvement of the print speed. Here, FIG. 3 illustrates flushing data FLD in a simplified manner. An arrow D in FIG. 3 shows a direction of data in the feed direction. The flushing data FLD is composed of a plurality of partial flushing data PtD assigned to each head 21 that constitutes the line head. In FIG. 3, the plurality of heads 21 are shown in order to show the correspondence relationship between the partial flushing data PtD and the head 21. The partial flushing data PtD is a bundle of pixel lines. Also, in FIG. 3, a part of the partial flushing data PtD is illustrated within a range extracted by a chain line. In this example, a part of a single pixel line (PL) is shown. A single pixel line is reproduced on the paper P by ink ejection with one of the nozzles 22. When each of the partial flushing data PtD is assigned to the corresponding head 21, an end portion of the partial flushing data PtD in a direction perpendicular to the feed direction is overlapped with an end portion of other partial flushing data PtD assigned to the next head 21.

The print control section 12*a* generates the flushing data FLD by generating each partial flushing data ND. In the case of the first flushing, the print control section 12*a* determines the dot pattern (dot on/off and the kind of dot in each pixel) of each partial flushing data PtD such that the ink amount becomes equal with respect to all the pixel lines of all the partial flushing data PtD. Also, in the case of the second flushing, the print control section 12*a* determines the dot pattern (dot on/off and the kind of dot in each pixel) of each partial flushing data PtD such that the ink amount becomes equal with respect to the pixel lines of all the partial flushing data PtD except for the nozzle 22 that is assigned to a prescribed margin area in which ink is not ejected. Accordingly, when the margin area is small, the area in which the second flushing area can be conducted is large, which reduces the ejection amount per unit area.

In the first embodiment, the print control section 12*a* sets a reference time interval that is determined such that clogging does not occur by considering time that can occur clogging of one of the nozzles 22 from one ejection using the ejection for forming image forming dots or flushing dots by the nozzle 22 as a starting point. Then, the print control section 12*a* determines a prescribed distance of movement of the paper P or the printing head 20 at the reference time interval for forming flushing dots. Here, the ejection frequency per time of the nozzle 22 can be lowered by reducing the ejection amount per unit area. Accordingly, the print control section 12*a* generates the flushing data FLD by considering the ejection frequency per time. Here, since the flushing data FLD is easily observed on the paper P when the number per raster increases, it is preferable to keep it around two shots per raster.

Figure 4:
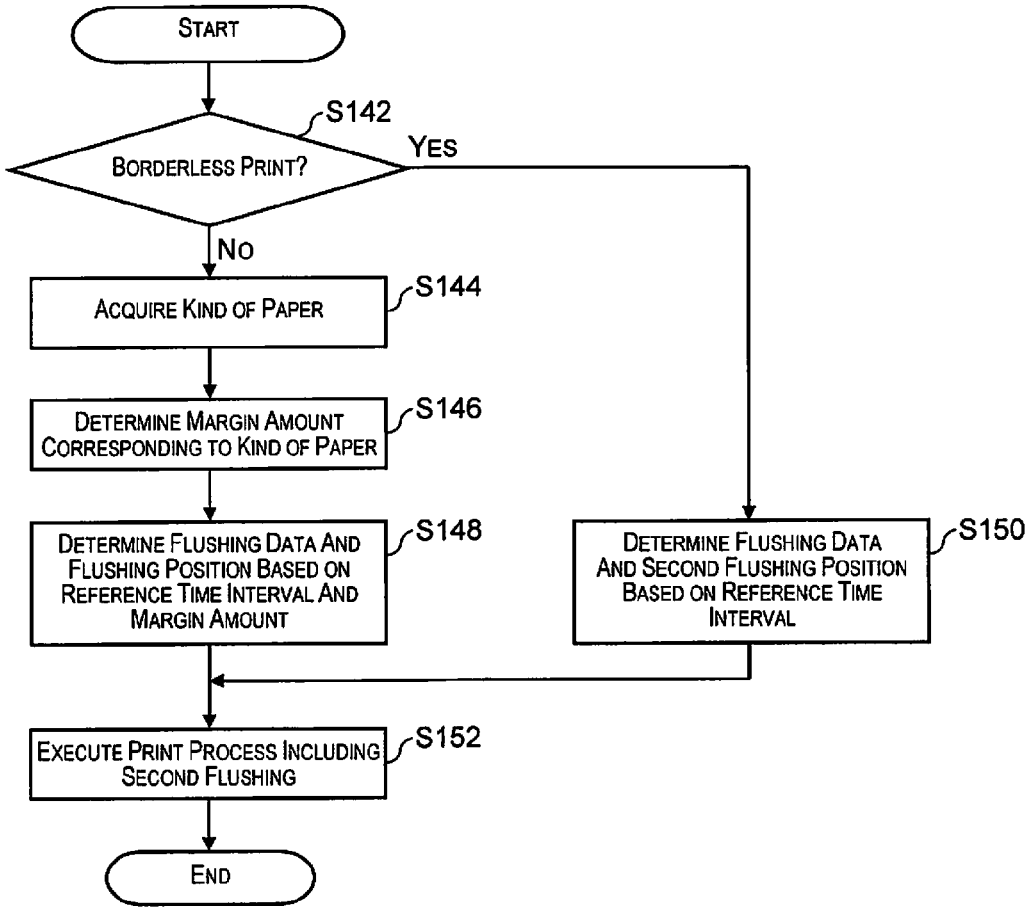
FIG. 4 is a flow chart that explains a second flushing process according to the first embodiment of the invention.

FIG. 4 is a flow chart that explains the second flushing process. This process is an embodiment of the printing method of the invention, and is executed as firmware in the first embodiment. When this process is started, the print control section 12*a* judges whether or not the print mode that defines the printing area is a prescribed mode (step S142). In the present embodiment, the print mode is a mode that determines whether or not a blank portion (border) of a prescribed width is provided in the four corners of the paper P, and it is judged whether or not a "borderless print mode" that conducts printing to the entire surface of the paper P without providing a "border" is set as the prescribed mode. Here, in a case in which the print control section 12*a* judges that the "borderless print mode" is set (Yes in step S142), a prescribed margin area is not set in both end sections of the paper P in the width direction. Therefore, the print control section 12*a* determines the flushing data FLD and the flushing position based on the reference time interval (step S150), and proceeds to step S152. On the other hand, in a case in which the print control section 12*a* judges that the "borderless print mode" is not set (No in step S142), the print control section 12*a* acquires information regarding the kind of the paper P from the printing conditions <acquiring step>.

Next, the print control section 12*a* determines a margin amount that specifies the prescribed margin area corresponding to the kind of paper (step S146). For example, in a case in which the kind of paper is any one of regular paper, heavy paper, a postcard, recycled paper, and gloss paper, the margin amount becomes larger in the order of gloss paper, heavy paper and a postcard, regular paper, and recycled paper. A preferred value of the margin amount corresponding to each kind of paper is determined in advance and stored in the ROM 14 or the like as a table. Here, in the first embodiment, the margin amount is set in the range of approximately 3 millimeters to several millimeters corresponding to the kind of paper. Next, the print control section 12*a* determines the flushing data FLD and the flushing position based on the reference time interval and the margin amount (step S148) <determining step>. For example, in order to make dots formed by flushing to the paper P under feeding less noticeable, the print control section 12*a* generates the flushing data FLD by considering the determined margin amount, and determines the flushing position such that the second flushing is executed to the paper P a prescribed number of times. Next, in step S152, the print control section 12*a* executes a print process associated with the second flushing, and finishes the process <executing step>.

Figure 5:
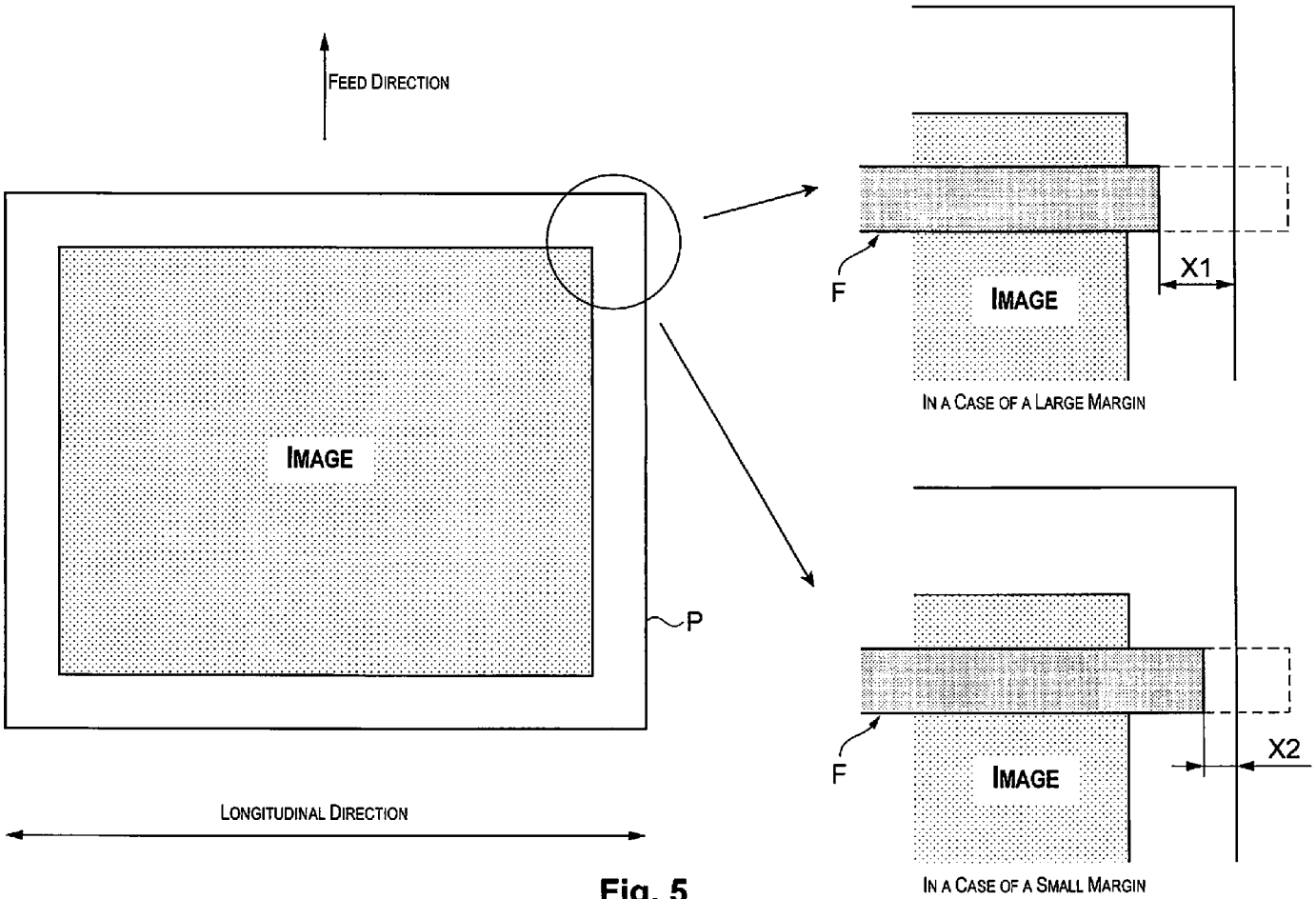
FIG. 5 is a diagram that shows a print example to paper in a case in which a prescribed margin area is set.

FIG. 5 shows a print example to the paper P in a case in which the prescribed margin area is set. In this example, a flushing pattern F is formed by the second flushing to be superimposed on the image portion of the paper P. The flushing pattern F shows an area in which flushing is conducted, and a user cannot easily observe the flushing pattern F. Here, in a case in which the kind of paper is recycled paper, the margin amount from an end portion of the paper P to an end portion of the flushing pattern F is X1. Also, in a case in which the kind of paper is gloss paper, the margin amount from an end portion of the paper P to an end portion of the flushing pattern F is X2 that is smaller than X1, and the margin area is smaller than that of recycled paper. Accordingly, in a case in which the kind of paper is recycled paper, even when a great amount of ink adheres to the paper P by printing, it is possible to prevent a curl phenomenon in which the paper P that has undergone printing is curved around the longitudinal direction from occurring due to the margin area of the margin amount X1. Also, in a case in which the kind of paper is gloss paper, the paper is thick and a curl phenomenon does not easily occur. Therefore, even when a great amount of ink adheres to the paper P by printing, it is possible to sufficiently prevent a curl phenomenon from occurring due to the margin area of the margin amount X2 that is smaller than X1.

According to the first embodiment, in a case of conducting the second flushing, the margin area in which no ink is ejected is provided in an end portion of the paper P, and the margin area is appropriately determined corresponding to the kind of the paper P to which printing is conducted. Therefore, even when a great amount of ink is ejected, onto the paper P by the second flushing, it is possible to prevent a curl phenomenon from occurring in the paper P. It is thus possible to prevent the print quality from being deteriorated caused by the paper P moving upward during printing, or prevent the paper P from being jammed in the printer 10.

Second Embodiment

Next, a second embodiment of the invention will be explained with reference to FIG. 6. In the following explanation, the same elements as the elements that have already been explained are given the same reference symbols, and the explanation thereof will be omitted. In the first embodiment, the kind of paper is used as the prescribed parameter of the printing conditions that determine the margin amount. In the second embodiment, the feed speed of the paper P is used as the prescribed parameter. In the second embodiment, the feed speed that determines the margin amount is determined based on the print resolution. For example, when the feed speed is low, feeding can be controlled with high accuracy. Therefore, the possibility that ink is ejected outside the paper P due to meandering of the paper P is low, and ejection close to the end portion of the paper P by the second flushing is possible. Accordingly, in a case in which the print resolution is high, that is, in a case in which the feed speed is low, the margin amount can be made small.

On the other hand, in a case in which the print resolution is low, the paper P is fed at high speed, which results in deterioration of the accuracy of feeding control. Therefore, the possibility that ink is ejected outside the paper P becomes high in an area close to the end portion of the paper P. Accordingly, in a case in which the print resolution is low, that is, in a case in which the feed speed is high, the margin amount is made large. Also, the feed speed that determines the margin amount can be determined based on the remaining amount of the precoat liquid. The precoat liquid is used for the purpose of aggregation of a pigment colorant with respect to pigment ink, and is used for the purpose of deposit of a dye colorant with respect to dye ink. In order to avoid deterioration of the coloring properties when the remaining amount of the precoat liquid is small, a technique that makes the feed speed low has been known (for example, see Japanese Laid-open Patent Publication No. 2012-91499). Therefore, in a case in which the remaining amount of the precoat liquid is smaller than a reference amount, that is, in a case in which the feed speed is low, therefore, the margin amount can be made small.

Figure 6:
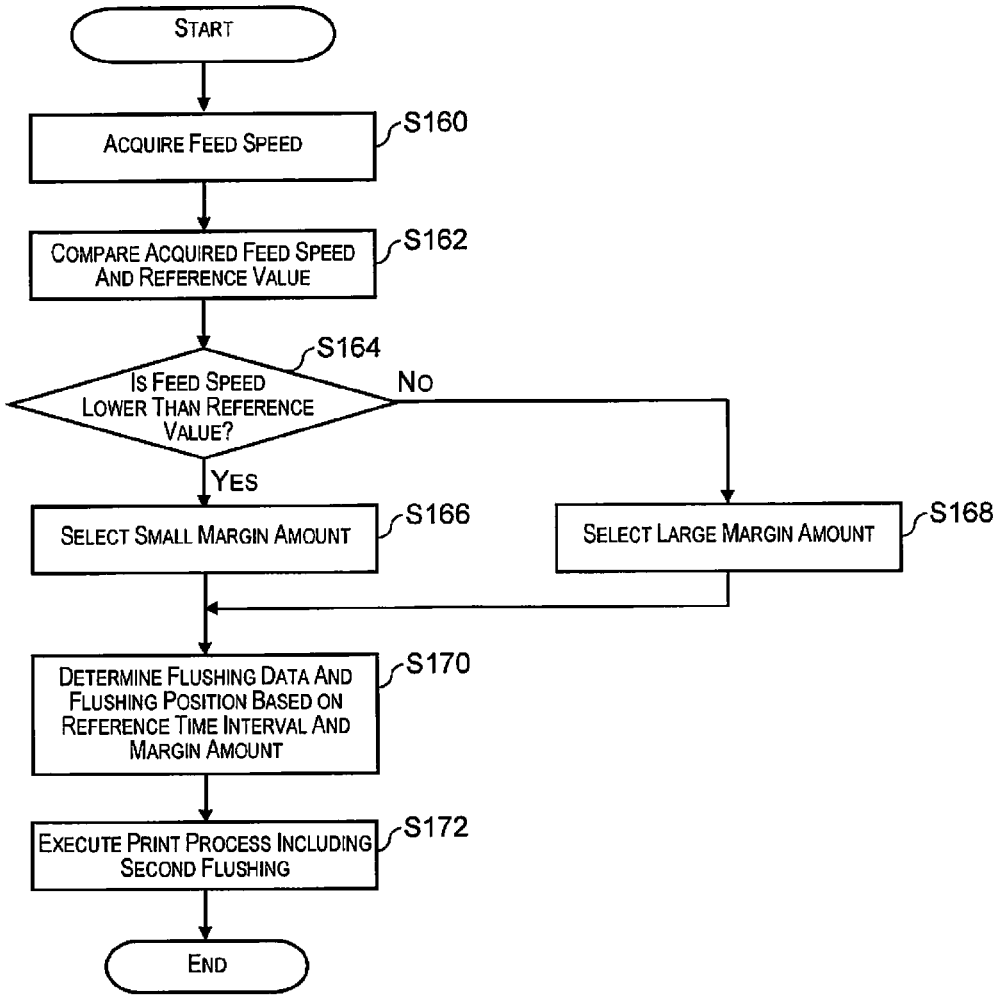
FIG. 6 is a flow chart that explains a second flushing process according to a second embodiment of the invention.

FIG. 6 is a flow chart that explains the second flushing process. When this process is started, the print control section 12*a* acquires the feed speed that is determined based on the print resolution of the printing conditions or the remaining amount of the precoat liquid (step S160). Next, the print control section 12*a* compares the acquired feed speed with a reference value that has been determined in advance (step S162). As a result of the comparison, in a case in which the feed speed is lower than the reference value (Yes in step S164), the print control section 12*a* selects a small margin amount (step S166), and proceeds to step S170. On the other hand, as a result of the comparison, in a case in which the feed speed is higher than the reference value (No in step S164), the print control section 12*a* selects a large margin amount (step S168), and proceeds to step S170. Here, in the second embodiment, either one of a small margin amount and a large margin amount is selected based on the comparison with the single reference value. However, a margin amount can be selected from three or more levels in comparison with two or more reference values. Also, the margin amount can be calculated by using a plurality of printing conditions including the feed speed as input values. In step S170, the print control section 12*a* determines the flushing data FLD and the flushing position based on the reference time interval and the determined margin amount. Next, in step S172, the print control section 12*a* executes a print process associated with the second flushing, and finishes the process.

According to the second embodiment described above, in the case of conducting the second flushing, the margin area in which no ink is ejected is provided in an end portion of the paper P, and the margin area that specifies the margin amount is appropriately determined corresponding to the feed speed of the paper P to which printing is conducted. Therefore, even when a great amount of ink is ejected by the second flushing, it is possible to prevent a curl phenomenon from occurring in the paper P. It is thus possible to prevent the print quality from being deteriorated caused by the paper P moving upward during printing, or prevent the paper P from being jammed in the printer 10. Preferred embodiments were explained in the above with reference to the drawings. However, preferred embodiments are not limited to these embodiments. It is apparent that the embodiments can be changed or modified without departing from the gist thereof, and the invention can be implemented as follows.

Modified Example

Figure 7:
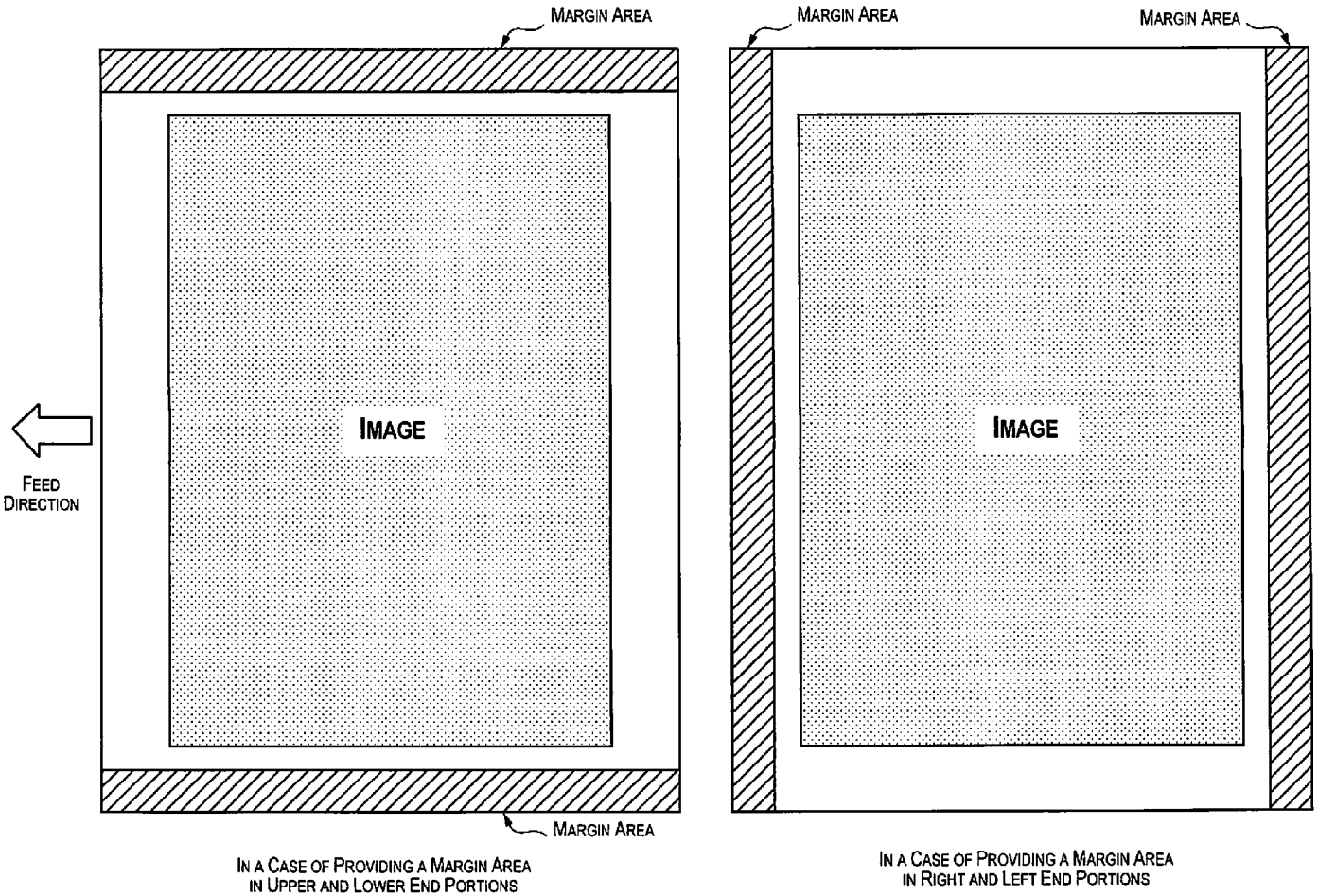
FIG. 7 is a diagram that explains a modified example.

In the above-described first and second embodiments, the margin area of the paper P sandwiches an image area in the longitudinal direction of the printing head 20, and is formed along the feed direction of the paper P. However, the invention is not limited to this. For example, grain information showing a fiber direction of the paper P can be acquired as the prescribed parameter, and as shown in FIG. 7, the end portion in which the margin area is provided can be changed corresponding to the grain information. A technique for detecting the grain direction has been disclosed in Japanese Laid-open Patent Publication No. 2011-170281. It can be input by a user, or can be included in the PDL data generated by the printer driver 41. By forming the margin area based on the acquired information on the grain direction, so-called "strength" is given to the paper P, and a curl phenomenon that will occur depending on the grain direction can be controlled. Therefore, deterioration of the print quality or occurrence of a paper jam can be avoided. The embodiments of the invention were explained with reference to the drawings. However, the detailed configurations are not limited to these embodiments, and the invention includes design modifications as long as they do not depart from the subject matter of the invention. For example, although the margin area is set in both end portions of the paper P, the margin area can be provided in only one of the end portions. In this case, it can be determined based on the ink ejection amount of an image printed onto the paper P. For example, in a case in which a blank area is large in an image on one side of the end portions, a margin area does not need to be set in the end portion on this side and a margin area can be set only in the end portion on the other side.

The printing conditions that determine the margin amount can be a combination of two or three of the grain direction of the paper, the kind of the paper, and the feed speed of the paper. The head is not limited to the line head. Specifically, another embodiment is possible in which printing is conducted by moving the head back and forth in a scanning direction perpendicular to the feed direction (sub scanning direction) of the paper P. Also, a device for implementing the above-described technique includes various kinds of embodiments. There are cases in which it is achieved by a single device, and there are cases in which it is achieved by combining a plurality of devices. Each configuration of each embodiment and the combination thereof are examples, and changes such as addition, omission or replacement of the configuration can be made without departing from the subject matter of the invention. The invention is not limited to the embodiments, and is limited only to the scope of claims.

What is claimed is:

1. A printing device, comprising:

a head that has a plurality of nozzles; and a control section that causes the head to execute an ejection operation of forming an image forming dot for printing an image designated as a print target and a flushing dot other than the image forming dot on a printing medium by moving either one of the printing medium and the head so as to relatively change the positions of the printing medium and the head and ejecting liquid from each of the nozzles, wherein the control section has an acquiring unit that acquires a prescribed parameter in printing conditions for forming the image forming dot on the printing medium, a determining unit that changes a size of a margin area in which the flushing dot is not formed in an end portion of the printing medium based on the prescribed parameter, and an executing unit that executes the ejection operation so as not to form the flushing dot in the margin area on the printing medium.

2. The printing device according to claim 1, wherein the printing medium is paper, and the prescribed parameter is at least one of the grain direction of the paper, the kind of the paper, and the feed speed of the paper.

3. The printing device according to claim 2, wherein the determining unit changes the size of the margin area based on a remaining amount of a chemical solution for causing aggregation or deposit of a colorant of the liquid, or a print resolution.

4. The printing device according to claim 1, wherein the determining unit does not provide the margin area in a case in which a print mode for defining a printing area to the printing medium is a prescribed mode.

5. The printing device according to claim 1, wherein in a case in which the control section causes the head to form the image forming dot on the printing medium, the control section generates flushing data that does not form the flushing dot in the margin area on the printing medium, superimposes the generated flushing data and print data showing the image to be printed, and causes the head to execute ejection of the liquid onto the printing medium based on the superimposed data.

6. The printing device according to claim 1, wherein the plurality of nozzles are arranged in the head in a direction that intersects with a direction for relatively changing the positions of the printing medium and the head.

7. A printing device comprising:

a head that has a plurality of nozzles; and a control section that causes the head to execute an ejection operation of forming an image forming dot for printing an image designated as a print target and a flushing dot other than the image forming dot on a printing medium by moving either one of the printing medium and the head so as to relatively change the positions of the printing medium and the head and ejecting liquid from each of the nozzles, wherein the control section has an acquiring unit that acquires a prescribed parameter in printing conditions for forming the image forming dot on the printing medium a determining unit that determines a margin area in which the flushing dot is not formed in an end portion of the printing medium based on the prescribed parameter, and an executing unit that executes the ejection operation so as not to form the flushing dot in the margin area on the printing medium, the printing medium is paper, and the prescribed parameter is at least one of the grain direction of the paper, the kind of the paper, and the feed speed of the paper, and the determining unit determines the margin area such that the margin area becomes larger in the order of gloss paper, heavy paper, regular paper, and recycled paper as the kind of paper.

* * * * *